US009599325B2

(12) United States Patent
Fryzek

(10) Patent No.: US 9,599,325 B2
(45) Date of Patent: Mar. 21, 2017

(54) RECESSED LUMINAIRE VISE-LIKE MOUNTING SYSTEM AND METHOD

(71) Applicant: ABL IP Holding LLC, Decatur, GA (US)

(72) Inventor: Aaron P. Fryzek, Wheaton, IL (US)

(73) Assignee: ABL IP Holding LLC, Decatur, GA (US)

( * ) Notice: Subject to any disclaimer, the term of this patent is extended or adjusted under 35 U.S.C. 154(b) by 8 days.

(21) Appl. No.: 14/620,512

(22) Filed: Feb. 12, 2015

(65) Prior Publication Data

US 2015/0241038 A1 Aug. 27, 2015

Related U.S. Application Data

(60) Provisional application No. 61/945,354, filed on Feb. 27, 2014.

(51) Int. Cl.

| | |
|---|---|
| ***F21S 8/00*** | (2006.01) |
| ***F21V 21/04*** | (2006.01) |
| ***F21S 8/02*** | (2006.01) |

(52) U.S. Cl.

CPC ..... *F21V 21/047* (2013.01); *F21S 8/026* (2013.01)

(58) Field of Classification Search

CPC .... F21V 21/047; F21V 21/048; F21V 21/049; F21S 8/026; F21S 8/028

USPC ..... 362/147

See application file for complete search history.

(56) References Cited

U.S. PATENT DOCUMENTS

| | | | | |
|---|---|---|---|---|
| 5,964,523 | A * | 10/1999 | Eversberg | F21V 21/04 362/148 |
| 8,215,805 | B2 | 7/2012 | Cogliano et al. | |
| 2010/0149822 | A1* | 6/2010 | Cogliano | F21S 8/02 362/365 |
| 2013/0016509 | A1* | 1/2013 | Van de Ven | F21V 7/00 362/235 |
| 2015/0103536 | A1* | 4/2015 | Wronski | F21V 21/04 362/365 |
| 2015/0264779 | A1* | 9/2015 | Olsen | F21S 10/023 315/294 |

OTHER PUBLICATIONS

Office Action for Mexican Patent Application No. MX/A/2015/002080, mailed Aug. 16, 2016, 6 pages (3 pages for English translation, 3 pages for MX OA).

* cited by examiner

*Primary Examiner* — Ali Alavi

(74) *Attorney, Agent, or Firm* — Kilpatrick Townsend & Stockton, LLP

(57) ABSTRACT

A mounting system for a recessed luminaire includes an upper frame 200 to fit within a cutout opening 141 in a ceiling 140, including pivotally mounted support levers 202 to overlap the upper surface of the ceiling. A lower frame 210 fits within the opening and has a trim face 220 that is configured to abut against the room-side surface of the ceiling. Clamping screws 212 fasten the lower frame to the upper frame and are adjustable to clamp varying thicknesses of ceilings between the support levers and the trim face when the screws are tightened. Fasteners 132 fasten a luminaire 100 to the lower frame, which is installed through the lower and upper frames, from the room-side of the ceiling. The mounting system and luminaire may be completely installed from below a ceiling that has limited space above the ceiling or when access above the ceiling is not available.

8 Claims, 8 Drawing Sheets

RECESSED LUMINAIRE VISE-LIKE MOUNTING SYSTEM AND METHOD

This patent application claims benefit under 35 U.S.C. 119(e), of the earlier filing date of U.S. Provisional Patent Application Ser. No. 61/945,354, filed Feb. 27, 2014.

BACKGROUND OF THE INVENTION

1. Field of the Invention

The invention disclosed relates generally to lighting fixtures and in particular to directional recessed lighting fixtures.

2. Discussion of the Related Art

A luminaire is generally considered to be a complete lighting unit consisting of a lamp or lamps together with the parts designed to distribute the light, to position and protect the lamps, and to connect the lamps to the power supply. Recessed luminaires are designed to be minimally visible from below a ceiling in which they are mounted. Many traditional methods of installing luminaires from below the ceiling require large vertical spaces above the ceiling for springs, brackets, and housings that fasten the luminaire to the ceiling.

An example recessed luminaire is described in U.S. Pat. No. 8,215,805, which depicts a recessed lighting adjustment assembly installed in a typical housing recessed above a ceiling. The bottom of the housing has a housing aperture defined by a rim that is registered with a cutout opening in the ceiling. A lamp assembly has a trim collar for attachment to the rim of the housing through the cutout opening in the ceiling. The trim collar fits through both the ceiling cutout and the housing aperture, and is secured to the rim of the housing by three circumferentially spaced collar clamps. The bottom of the trim collar is a flange-shaped trim face that is pushed up against the ceiling during installation, to be flush with the room-side of the ceiling. The collar clamps are vertically adjustable on the collar in vertical slots, such that the clamps and the housing can be raised or lowered on the collar as needed to compensate for differences in the thickness of the ceiling. However, the luminaire requires that it be clamped to the rim of the recessed housing that had to be previously installed from above the ceiling. The pre-installed housing requires a large vertical space above the ceiling.

Accordingly, there is a need for a mounting system for a recessed luminaire that may be completely installed from below a ceiling that has limited space above the ceiling. What is needed is a mounting system for a recessed luminaire, which does not require previously installing a recessed housing from above the ceiling. What is needed is a mounting system for a recessed luminaire that may be completely installed from below a ceiling when access above the ceiling is not available. What is needed is a mounting system for a recessed luminaire that is easily installed in architectural panels, such as ceilings or walls, having a variety of thicknesses. What is needed is a mounting system for a recessed luminaire that may be completely installed from below a ceiling, and which does not limit or interfere with the rotational adjustment or angular tilt of the light beam from the luminaire.

SUMMARY OF THE INVENTION

Example embodiments of the invention provide a mounting system for a recessed luminaire, which may be completely installed from below a ceiling that has limited space above the ceiling. Example embodiments of the invention provide a mounting system for a recessed luminaire, which does not require previously installing a recessed housing from above the ceiling. Example embodiments of the invention provide a mounting system for a recessed luminaire, which may be completely installed from below a ceiling when access above the ceiling is not available. Example embodiments of the invention provide a mounting system for a recessed luminaire, which is easily installed in architectural panels, such as ceilings or walls having a variety of thicknesses.

In accordance with an example embodiment of the invention, a mounting system for a recessed luminaire includes an upper frame that is generally annular in shape and configured to fit within a cutout opening in a ceiling having a room-side surface and a back surface behind the ceiling. The upper frame may include a support lever pivotally mounted on the upper frame. There may be one or more support levers configured to overlap the upper frame when the upper frame is being inserted into the cutout opening from the room-side surface of the ceiling. The support levers may be further configured to pivot away from overlapping the upper frame and move to overlap the back surface of the ceiling in an area of the back surface surrounding the cutout opening, after the upper frame has been inserted into the cutout opening from the room-side surface of the ceiling.

The mounting system for a recessed luminaire further includes a lower frame that is generally annular in shape and configured to fit within the cutout opening in the ceiling when the lower frame is inserted into the cutout opening from the room-side surface of the ceiling. The lower frame may include a trim face surrounding a lower edge of the lower frame, which projects outwardly from the lower frame. The trim face may be configured to abut against the room-side surface of the ceiling, when the lower frame is inserted into the cutout opening from the room-side surface of the ceiling.

The mounting system for a recessed luminaire further includes clamping screws configured to fasten the lower frame to the upper frame. The clamping screws are configured to clamp the ceiling between the support levers on the upper frame and the trim face surrounding a lower edge of the lower frame when the screws are tightened. The clamping screws may be adjustable to clamp varying thicknesses of the ceiling.

The luminaire is sized to be passed through the upper frame and the lower frame from the room-side surface of the ceiling.

The mounting system for a recessed luminaire further includes fasteners configured to fasten the luminaire to the lower frame, from the room-side surface of the ceiling.

The mounting system for a recessed luminaire may be installed by an installer assembling the generally annular shaped frame assembly, by fastening the generally annular shaped upper frame to the generally annular shaped lower frame with clamping screws, the clamping screws being adjustable to clamp varying thicknesses of ceiling by the lower frame and the upper frame.

The installer pivots the support levers inwardly on the upper frame, so as to clear the ceiling during the insertion. The installer then inserts the generally annular shaped frame assembly into the cutout opening in the ceiling. After fully inserting the frame assembly, the trim face surrounding a lower edge of the lower frame, abuts against the room-side surface of the ceiling.

The installer then reaches through the annular frame assembly to position the support levers pivotally mounted on the upper frame, to overlap the back surface of the ceiling in an area of the back surface surrounding the cutout opening.

The installer then tightens the clamping screws fastening the upper frame to the lower frame, to clamp the ceiling between the support levers on the upper frame and the trim face surrounding a lower edge of the lower frame, the tightening being by access from the room-side of the ceiling.

The installer may then pass the luminaire through the generally annular shaped frame assembly, from the room-side of the ceiling.

Finally, the installer may then fasten the luminaire to the lower frame with fasteners, by access from the room-side of the ceiling.

The generally annular shape of the upper frame and the lower frame may be circular or rectangular. The luminaire may be a low profile, variable direction luminaire.

In this manner, example embodiments of the invention provide a mounting system for a recessed luminaire, which may be completely installed from below a ceiling that has limited space above the ceiling. Example embodiments of the invention provide a mounting system for a recessed luminaire, which does not require previously installing a recessed housing from above the ceiling. Example embodiments of the invention provide a mounting system for a recessed luminaire, which may be completely installed from below a ceiling when access above the ceiling is not available. Example embodiments of the invention provide a mounting system for a recessed luminaire, which is easily installed in ceilings having a variety of thicknesses.

DETAILED DESCRIPTION OF EMBODIMENTS OF THE INVENTION

Figure 1:
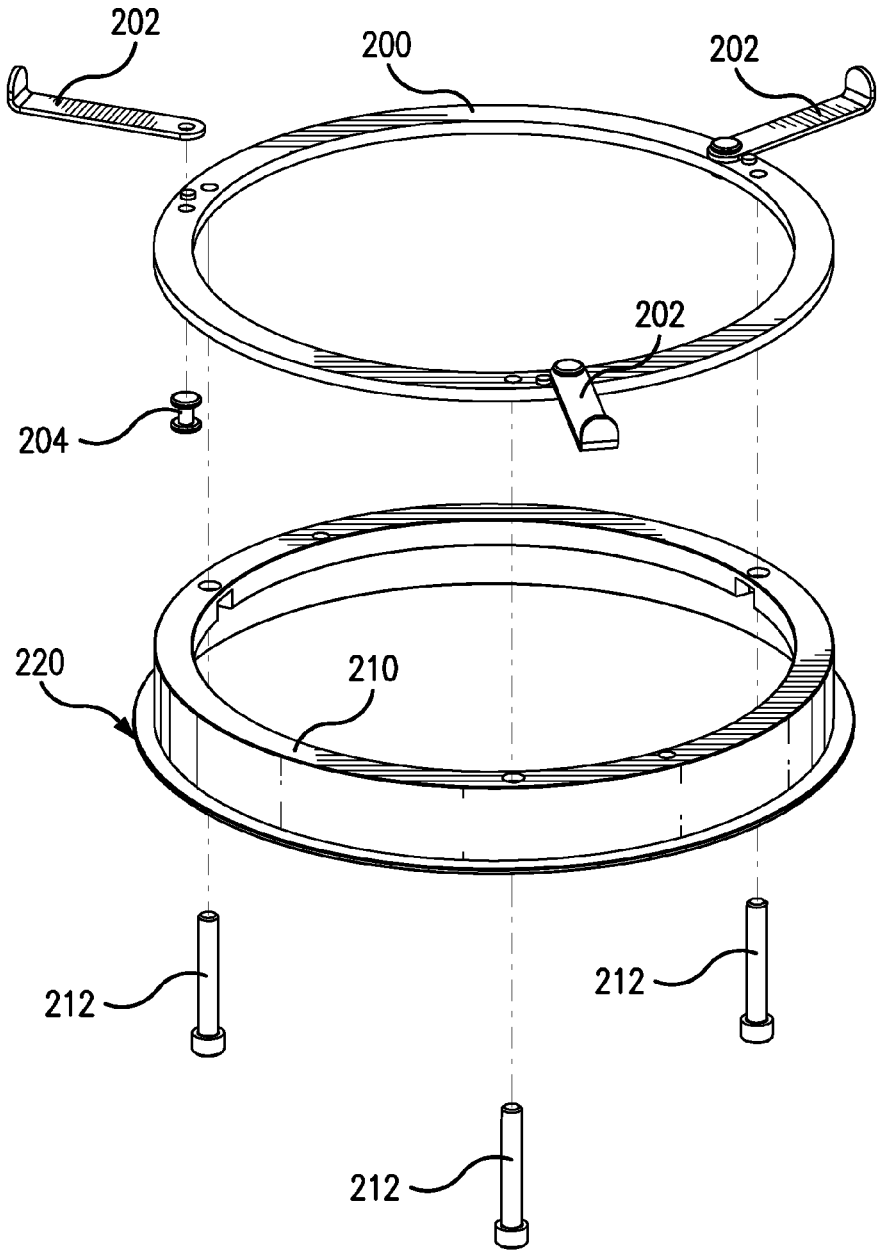
FIG. 1 is a top front perspective, exploded view of an example mounting system for a recessed luminaire, which includes an upper frame and a lower frame being configured to fit within a cutout opening in a ceiling. The figure shows an example embodiment wherein the upper frame and lower frame have a generally annular shape that is circular.
Figure 2:
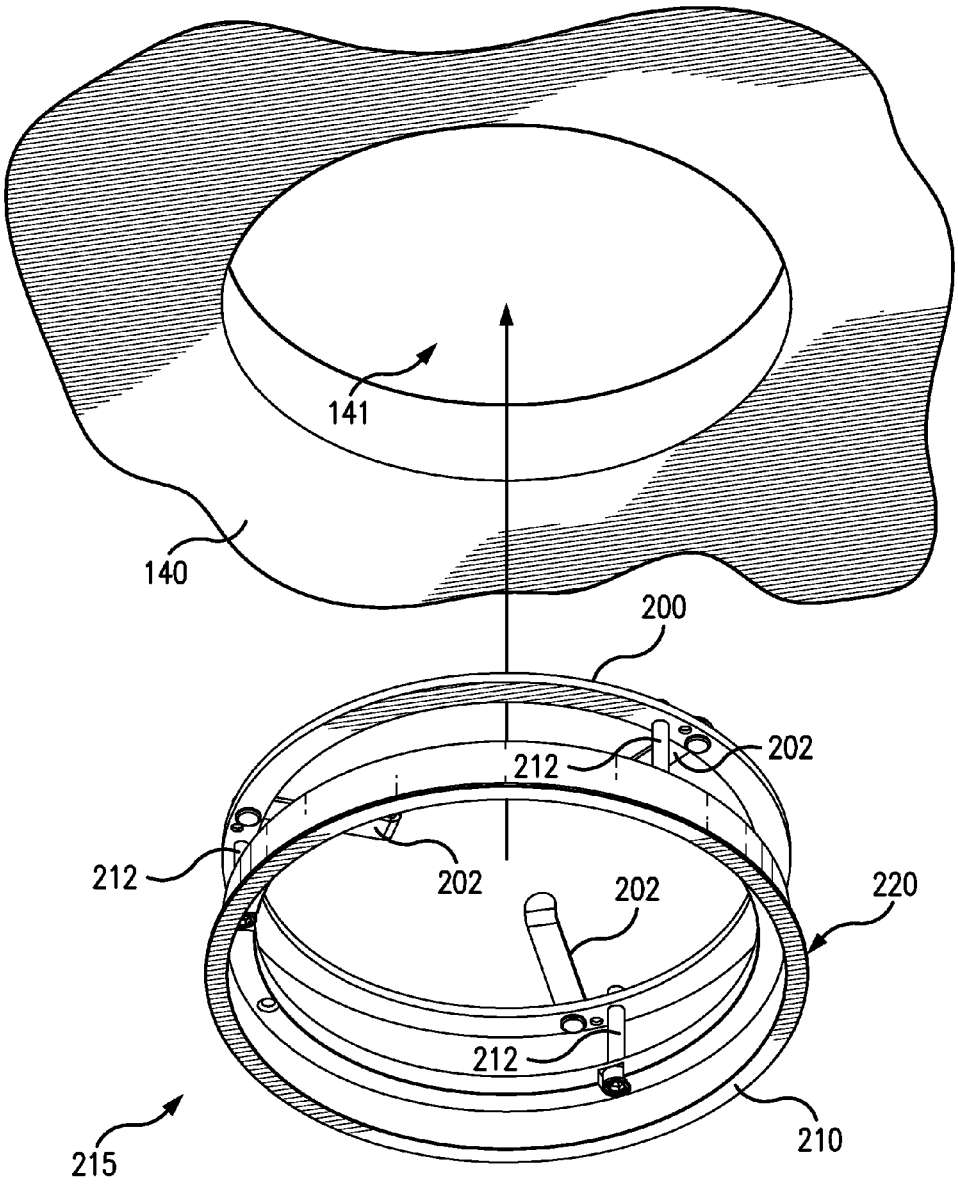
FIG. 2 is a bottom front perspective view of the example mounting system for a recessed luminaire shown in FIG. 1, with the upper frame and a lower frame having been connected together by the clamping screws to form a frame assembly. The frame assembly is shown being upwardly inserted into a cutout opening in a ceiling, with the trim face of the lower frame abutting the ceiling. The support levers are shown having been pivoted inwardly on the upper frame to overlap the upper frame so as to clear the ceiling, while it is being inserted into the cutout opening from the room-side surface of the ceiling.
Figure 3:
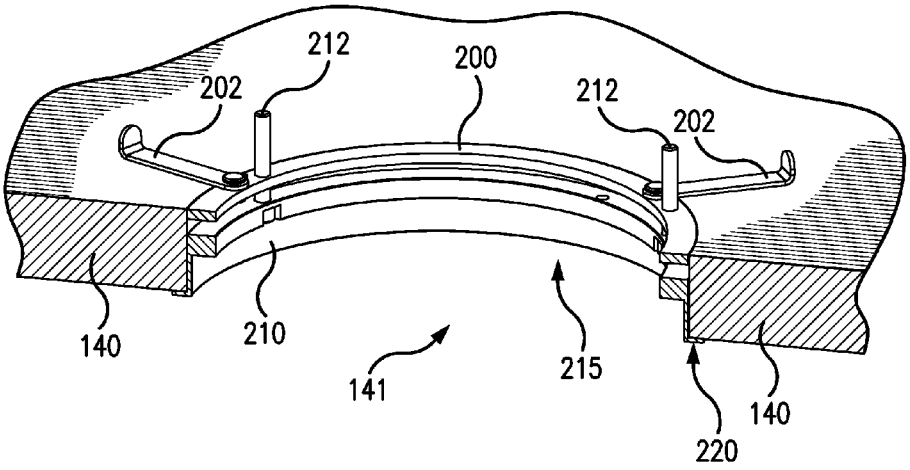
FIG. 3 is a top front perspective, view from the left side, in partial cross-section, of the example mounting system for a recessed luminaire shown in FIG. 1, showing the frame assembly having been inserted into the cutout opening of the ceiling. The support levers are shown having been pivoted away from overlapping the upper frame and moved to overlap the back surface of the ceiling in an area of the back surface surrounding the cutout opening, after the upper frame has been inserted into the cutout opening from the room-side surface of the ceiling, with the trim face of the lower frame abutting the ceiling. The figure shows the clamping screws having been adjusted to clamp the ceiling between the trim face of the lower frame and the support levers of the upper frame. The clamping screws are adjustable to clamp varying thicknesses of ceilings.

FIG. 1 is a top front perspective, exploded view of an example mounting system for a recessed luminaire, which includes an upper frame 200 and a lower frame 210 being configured to fit within a cutout opening 141 (shown in FIG. 2) in an architectural panel, such as the ceiling 140 (shown in FIG. 2). The upper frame 200 is generally annular in shape and is shown as circular in FIG. 1. The upper frame 200 includes a support lever 202, of which three are shown in FIG. 1. The support levers, collectively, 202 are pivotally mounted by rivets 204 on the upper frame 200, and are configured to overlap the upper frame 200 when the upper frame is being inserted into the cutout opening 141 from the room-side surface of the ceiling 140, to clear the ceiling, as shown in FIG. 2. The support levers 202 are configured to pivot away from overlapping the upper frame 200 and move to overlap a back surface of the ceiling 140 in an area of the back surface surrounding the cutout opening 141, as shown in FIG. 3, after the upper frame 200 has been inserted into the cutout opening 141 from a room-side surface of the ceiling 140.

The lower frame 210 includes a trim face 220 surrounding a lower edge of the lower frame 210. The trim face 220 projects outwardly from the lower frame 210 and is configured to abut against the room-side surface of the ceiling 140, when the lower frame 210 is inserted into the cutout opening 141 from the room-side surface of the ceiling 140.

The figure shows clamping screws 212, with three being shown in the figure. The clamping screws 212 are configured to fasten the lower frame 210 to the upper frame 200. The clamping screws 212 are adjustable to clamp varying thicknesses of a ceiling between the trim face 220 of the lower frame 210 and the support levers 202 of the upper frame 200.

In an alternate example embodiment of the invention, the upper frame 200 and lower frame 210 may have a generally annular shape that is rectangular and be configured to fit within a rectangular cutout opening.

FIG. 2 is a bottom front perspective view of the example mounting system for a recessed luminaire shown in FIG. 1, with the upper frame 200 and a lower frame 210 having been connected together by the clamping screws 212 to form a frame assembly 215. The frame assembly 215 is shown being upwardly inserted into the cutout opening 141 in the ceiling 140. The support levers 202 are shown having been pivoted inwardly on the upper frame 200 to overlap the upper frame 200 and clear the ceiling, while the frame assembly 215 is being inserted into the cutout opening 141 from the room-side surface of the ceiling 140.

FIG. 3 is a top front perspective view from the left side, in partial cross-section, of the example mounting system for a recessed luminaire shown in FIG. 1, showing the frame assembly 215 having been inserted into the cutout opening 141 of the ceiling 140, with the trim face 220 abutting the ceiling. The support levers 202 are shown having been pivoted away from overlapping the upper frame 200 and moved to overlap the back surface of the ceiling 140 in an area of the back surface surrounding the cutout opening 141, after the upper frame 200 has been inserted into the cutout opening 141 from the room-side surface of the ceiling 140. The figure shows the clamping screws 212 having been adjusted to clamp the ceiling 140 between the trim face 220 of the lower frame 210 and the support levers 202 of the upper frame 200. The clamping screws 212 are adjustable to clamp varying thicknesses of ceiling 140, between the trim face 220 of the lower frame 210 and the support levers 202 of the upper frame 200.

Figure 4:
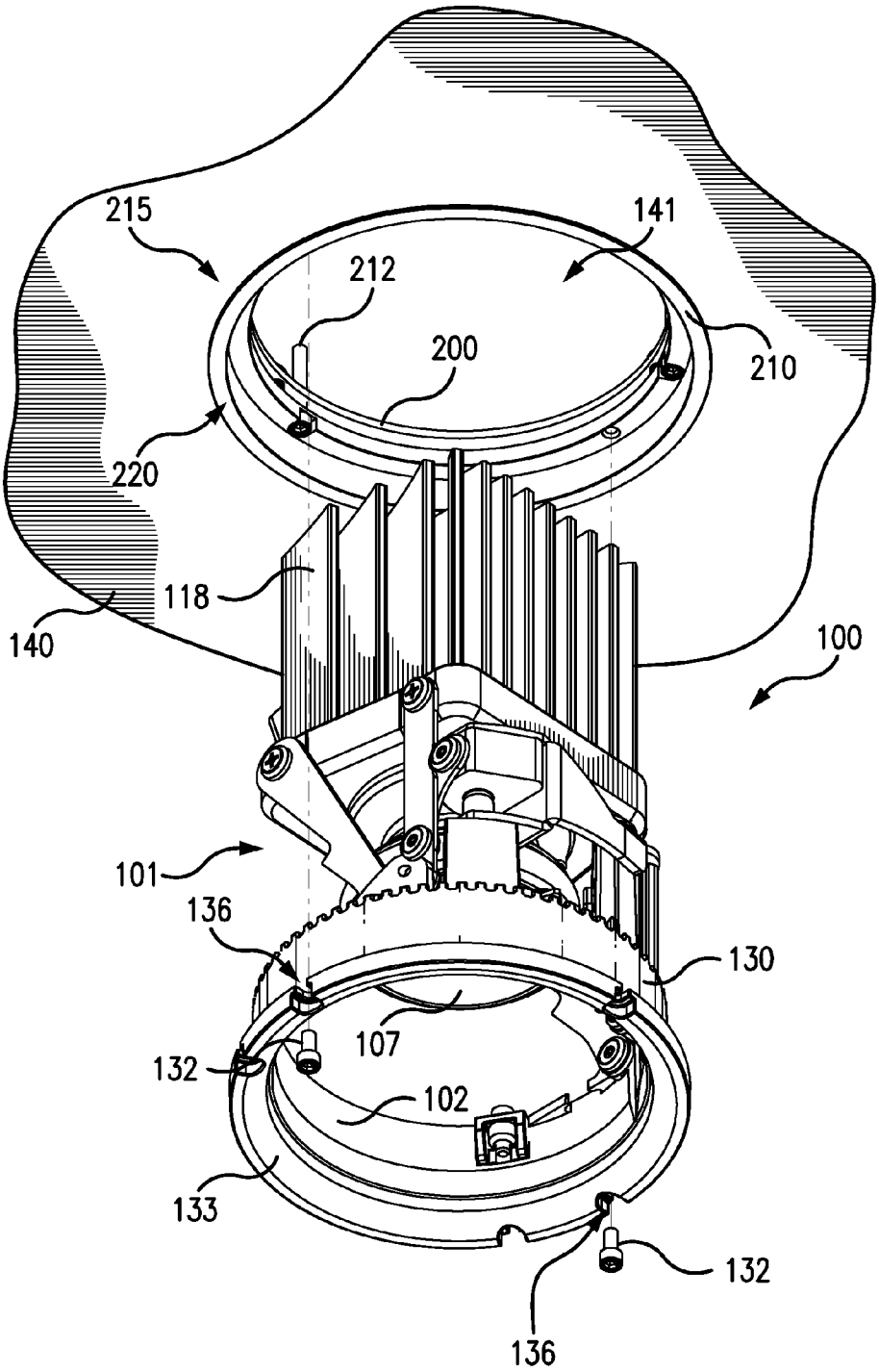
FIG. 4 is a bottom front perspective view of the example mounting system for a recessed luminaire shown in FIG. 3, after the frame assembly has been inserted into the cutout opening in the ceiling and clamped into place. The figure shows a low profile, variable direction recessed luminaire being upwardly inserted into the frame assembly, from the room-side of the ceiling. Screw fasteners are used to fasten a lower rim of the luminaire to the lower frame. The mounting system and luminaire may be completely installed from below a ceiling that has limited space above the ceiling or when access above the ceiling is not available.

FIG. 4 is a bottom front perspective view of the example mounting system for a recessed luminaire shown in FIG. 3, after the frame assembly 215 has been inserted into the cutout opening 141 in the ceiling 140 and clamped into place. The figure shows a low profile, variable direction recessed luminaire 100 being upwardly inserted into the frame assembly 215, from the room-side of the ceiling 140. Screw fasteners 132, two are shown in the figure, are used to fasten slots 136 of a lower rim 133 on a ring gear 130 of the luminaire 100, to the lower frame 210. The mounting system and luminaire may be completely installed from below a ceiling that has limited space above the ceiling or when access above the ceiling is not available. The luminaire may be completely installed from the room side of a ceiling that has a minimum depth of 3½ inches behind the non-room side of the ceiling, for example in a ceiling having joists of 2×4 construction. The figure shows several parts of the luminaire, including a four bar linkage adjustment mechanism 101, a rotatable base 102, an optic 107, a heat sink 118, and the ring gear 130.

Figure 5:
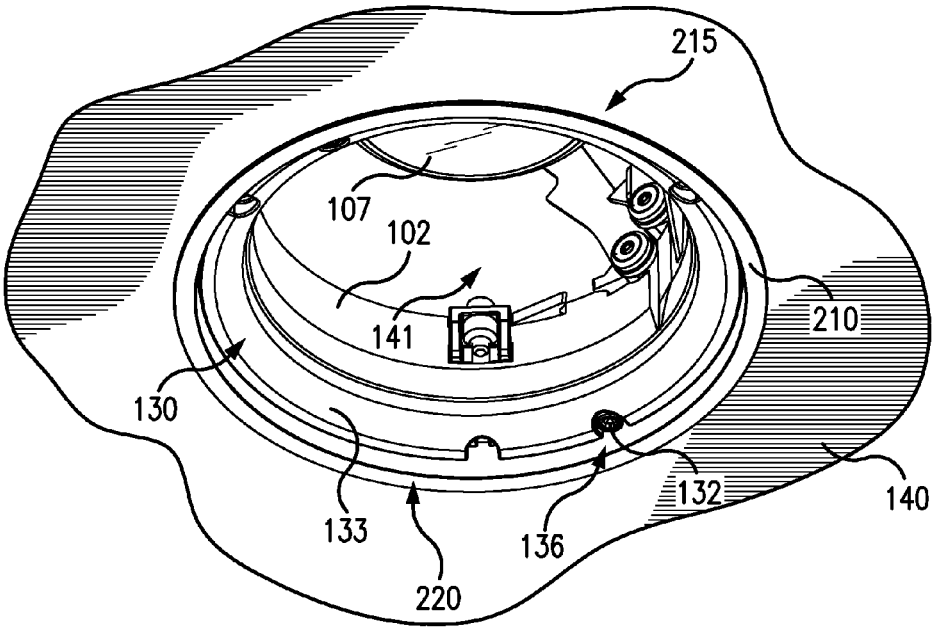
FIG. 5 is a bottom front perspective view of the example mounting system for a recessed luminaire shown in FIG. 4, after the lower rim of the luminaire has been fastened to the lower frame of the frame assembly in the cutout opening in the ceiling.

FIG. 5 is a bottom front perspective view of the example mounting system for a recessed luminaire shown in FIG. 4, after the lower rim 133 of the luminaire 100 has been fastened to the lower frame 210 of the frame assembly 215 by means of the screw fasteners 132, in the cutout opening 141 in the ceiling 140. The figure also shows various parts of the luminaire 100, including the rotatable base 102 and optic 107.

Figure 6:
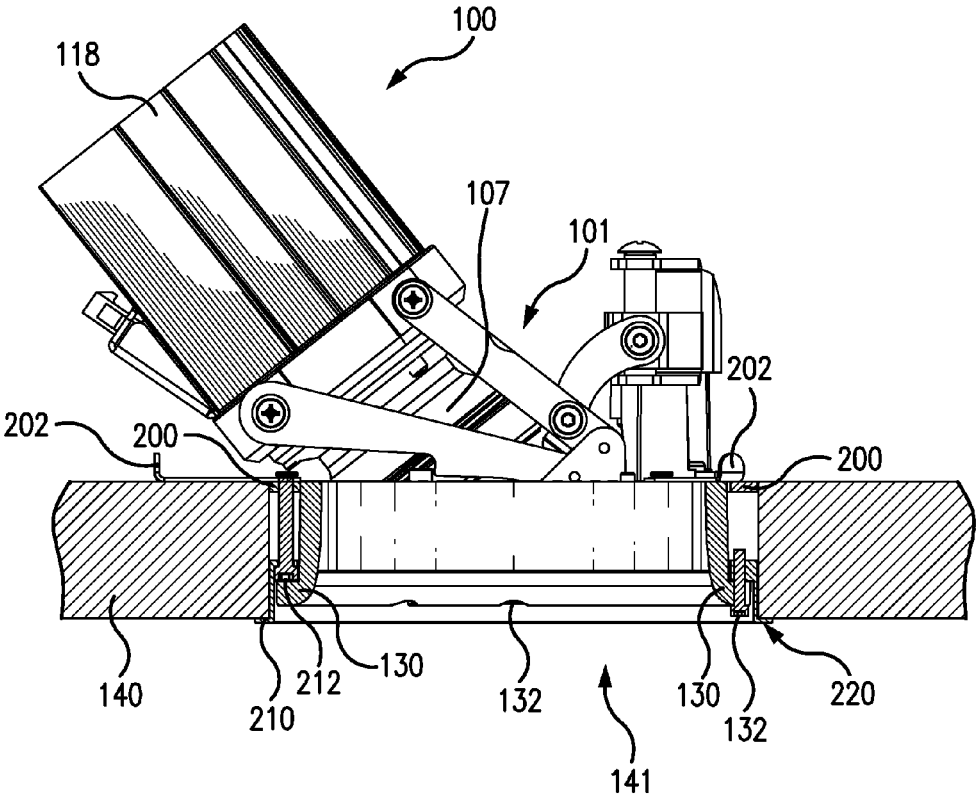
FIG. 6 is a side view in partial cross section, of the example mounting system for a recessed luminaire shown in FIG. 5, showing the frame assembly clamped in the ceiling and the lower rim of the low profile, variable direction recessed luminaire fastened to the lower frame of the frame assembly in the cutout opening in the ceiling.

FIG. 6 is a side view in partial cross section, of the example mounting system for a recessed luminaire shown in FIG. 5, showing the frame assembly 215 clamped in the ceiling 140 by means of the clamping screws 212. The support levers 202 are shown overlapping the back surface of the ceiling 140, to support the upper frame 200 in the cutout opening 141 of the ceiling 140. The upper frame 200, in turn, supports the lower frame 210 by means of the clamping screws 212. The trim face 220 surrounding a lower edge of the lower frame 210, is configured to abut the room-side surface of the ceiling 140, when the lower frame 210 is inserted into the cutout opening 141 from the room-side surface of the ceiling 140. The action of the clamping screws 212 being tightened draws the trim face 220 up tight against the room-side surface of the ceiling 140, thereby clamping the ceiling between the support levers 202 of the upper frame 200 and trim face 220 of the lower frame 210. The lower frame 210 supports the low profile, variable direction recessed luminaire 100. The lower rim of the ring gear 130 of the luminaire is fastened to the lower frame 210 with the screw fasteners 132.

Figure 7:
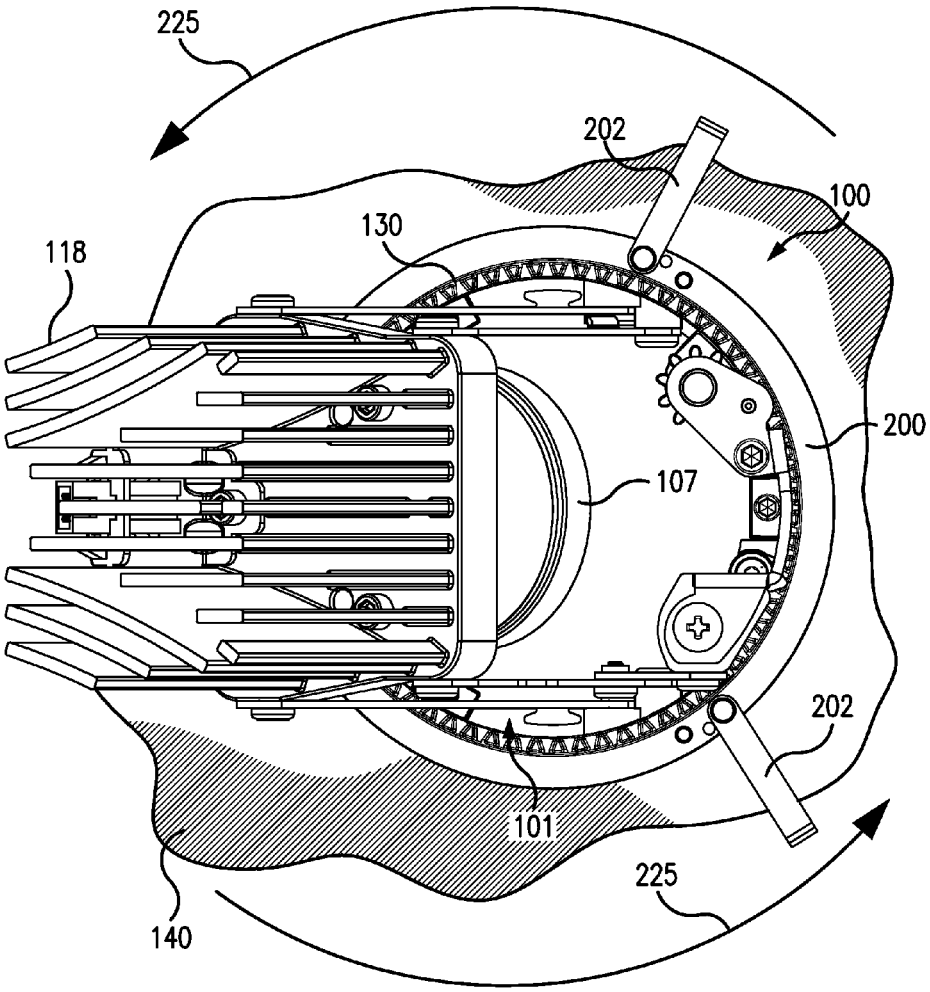
FIG. 7 is a top perspective view of the example mounting system for a recessed luminaire shown in FIG. 6, showing the frame assembly clamped in the ceiling. The support levers are shown having been pivoted away from overlapping the upper frame and moved to overlap the back surface of the ceiling in the area of the back surface surrounding the cutout opening. The low contour of the mounting system, when clamped in the ceiling, provides room within a confined space above the ceiling, to enable the recessed luminaire to be tilted and rotated to adjust the direction of the light beam it projects into the room below the ceiling.

FIG. 7 is a top perspective view of the example mounting system for a recessed luminaire shown in FIG. 6, showing the frame assembly 215 clamped in the ceiling 140. The support levers 202 are shown having been pivoted away from overlapping the upper frame 200 and moved to overlap the back surface of the ceiling 140 in the area of the back surface surrounding the cutout opening 141. The low contour of the mounting system, when clamped in the ceiling, provides room within a confined space above the ceiling, to enable the recessed luminaire to be tilted and rotated at 225, to adjust the direction of the light beam it projects into the room below the ceiling.

The mounting system for a recessed luminaire may be installed by an installer assembling the generally annular shaped frame assembly 215, by fastening the generally annular shaped upper frame 200 to the generally annular shaped lower frame 210 with clamping screws 212, the clamping screws being adjustable to clamp varying thicknesses of ceiling 140 with the lower frame and the upper frame.

The installer pivots the support levers inwardly on the upper frame, so as to clear the ceiling during the insertion. The installer then inserts the generally annular shaped frame assembly 215 into the cutout opening 141 in the ceiling 140. After fully inserting the frame assembly 215, the trim face 220 surrounding a lower edge of the lower frame 210, abuts against the room-side surface of the ceiling 140.

The installer then reaches through the annular frame assembly 215, from the room-side of the ceiling, to position the support levers 202 pivotally mounted on the upper frame 200, to overlap the back surface of the ceiling 140 in an area of the back surface surrounding the cutout opening 141.

The installer then tightens the clamping screws 212 fastening the upper frame 200 to the lower frame 210, to clamp the ceiling 140 between the support levers 202 on the upper frame 200 and the trim face 220 surrounding a lower edge of the lower frame 210, the tightening being by access from the room-side of the ceiling.

The installer may then pass the luminaire 100 through the generally annular shaped frame assembly 215, from the room-side of the ceiling.

Finally, the installer may then fasten the luminaire 100 to the lower frame 210 with fasteners 132, by access from the room-side of the ceiling.

Figure 8A:
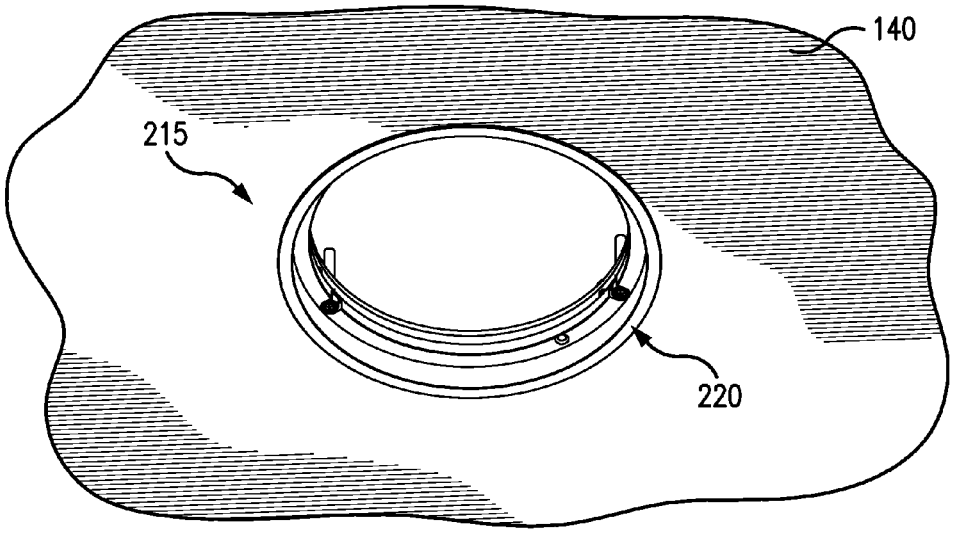
FIG. 8A is a bottom front perspective view of the example mounting system for a recessed luminaire shown in FIG. 1, showing a circular trim surrounding a circular cutout opening in the ceiling

FIG. 8A is a bottom front perspective views of the example mounting system for a recessed luminaire shown in FIG. 1, showing a circular trim face 220 surrounding a circular cutout opening in the ceiling 140.

Figure 8B:
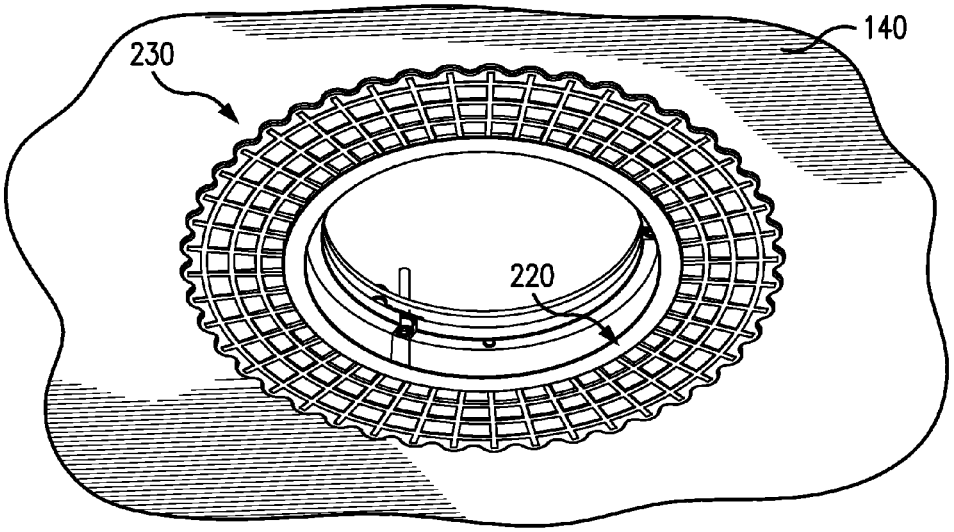
FIG. 8B is an embodiment where the lower frame has a larger sized trim face that is designed to be covered with and imbedded in plaster or joint compound as a flush mount, also referred to as "trimless" in the industry, which is finished such that it appears to be an integral part of the ceiling. This allows a finishing trim of the luminaire to sit flush with the ceiling surface, as opposed to the finishing trim overlapping the lower frame as the lower frame is designed in FIG. 8A.

FIG. 8B is an embodiment where the lower frame 210 has a larger sized trim face 230 that is designed to be covered with and imbedded in plaster or joint compound as a flush mount, also referred to as "trimless" in the industry, which is finished such that it appears to be an integral part of the ceiling 140. This allows a finishing trim of the luminaire to sit flush with the ceiling surface, as opposed to the finishing trim overlapping the lower frame as the lower frame is designed in 8A.

In an alternate example embodiment of the invention, the frame assembly 215 may have a rectangular trim 230 surrounding a rectangular cutout opening in the ceiling 140, presenting a flush appearance upon finishing the ceiling.

In this manner, example embodiments of the invention provide a mounting system for a recessed luminaire, which may be completely installed from below a ceiling that has limited space above the ceiling. Example embodiments of the invention provide a mounting system for a recessed luminaire, which does not require previously installing a recessed housing from above the ceiling. Example embodiments of the invention provide a mounting system for a recessed luminaire, which may be completely installed from below a ceiling when access above the ceiling is not available. Example embodiments of the invention provide a mounting system for a recessed luminaire, which is easily installed in ceilings having a variety of thicknesses.

The invention claimed is:

1. A mounting system for a recessed luminaire, comprising:

an upper frame being generally annular in shape and being configured to fit within a cutout opening in an architectural panel having a room-side surface and a non-room-side surface behind the architectural panel, the upper frame including support levers pivotally mounted on the upper frame, the support levers being configured to overlap the upper frame when the upper frame is being inserted into the cutout opening from the room-side surface of the architectural panel, the support levers being configured to pivot away from overlapping the upper frame and move to overlap the non-room-side surface of the architectural panel in an area of the non-room-side surface surrounding the cutout opening, after the upper frame has been inserted into the cutout opening from the room-side surface of the architectural panel;

a lower frame being generally annular in shape and being configured to fit within the cutout opening in the architectural panel when the lower frame is inserted into the cutout opening from the room-side surface of the architectural panel, the lower frame including a trim face surrounding a lower edge of the lower frame, the trim face projecting outwardly from the lower frame, the trim face abutting against the room-side surface of the architectural panel, when the lower frame is inserted into the cutout opening from the room-side surface of the architectural panel;

clamping screws being configured to fasten the lower frame to the upper frame, the clamping screws being configured to clamp the architectural panel between the support levers on the upper frame and the trim face surrounding the lower edge of the lower frame when the screws are tightened, the clamping screws being adjustable to clamp varying thicknesses of the architectural panel; and fasteners being configured to fasten a luminaire to the lower frame, from the room-side surface of the architectural panel.

2. The mounting system of claim 1, wherein the generally annular shape of the upper frame and the lower frame is circular.

3. The mounting system of claim 1, further including the luminaire sized to be passed through the upper frame and the lower frame, and the luminaire being mounted by the fasteners to the lower frame.

4. The mounting system of claim 3, wherein the luminaire is a variable direction luminaire extending 3½" or less behind the non-room-side surface of the architectural panel.

5. The mounting system of claim 3, wherein the luminaire can be completely installed from the room side of the architectural panel that has a minimum depth of 3½" behind the non-room side of the architectural panel.

6. The mounting system of claim 1, wherein the architectural panel is a ceiling.

7. A method of installing a recessed luminaire in an architectural panel, comprising:

assembling a generally annular shaped frame assembly by fastening a generally annular shaped upper frame to a generally annular shaped lower frame with clamping screws, the clamping screws being adjustable to clamp varying thicknesses of the architectural panel with the lower frame and the upper frame;

inserting the generally annular shaped frame assembly into a cutout opening in the architectural panel having a room-side surface and a non-room-side surface behind the architectural panel, so that a trim face surrounding a lower edge of the lower frame abuts against the room-side surface of the architectural panel, the inserting being by access from the room side of the architectural panel;

positioning support levers pivotally mounted on the upper frame, to overlap the non-room-side surface of the architectural panel in an area of the non-room-side surface surrounding the cutout opening, after the frame assembly has been inserted into the cutout opening from the room-side surface of the architectural panel, the positioning being by access from the room side of the architectural panel;

tightening the clamping screws fastening the upper frame to the lower frame to clamp the architectural panel between the support levers on the upper frame and the trim face surrounding a lower edge of the lower frame, the tightening being by access from the room-side of the architectural panel;

passing a luminaire through the generally annular shaped frame assembly, from the room side of the architectural panel; and fastening the luminaire to the lower frame with fasteners, by access from the room side of the architectural panel.

8. The method of claim 7, wherein the luminaire can be completely installed from the room side of the architectural panel that has a minimum depth of 3½" behind the non-room side of the architectural panel.

* * * * *